United States Patent [19]

Barnhart et al.

[11] 4,336,749

[45] Jun. 29, 1982

[54] FAN HOUSING UNIT AND MOUNTING DEVICE THEREFOR

[75] Inventors: David A. Barnhart, Madiera; John E. Kroger, Centerville; David A. Walters, Middletown, all of Ohio

[73] Assignee: The Celotex Corporation, Tampa, Fla.

[21] Appl. No.: 31,268

[22] Filed: Apr. 18, 1979

[51] Int. Cl.[3] ..... F24F 7/00

[52] U.S. Cl. ..... 98/43 R; 98/116; 248/58

[58] Field of Search ..... 98/43 B, 40, 43 R, 116; 240/47, 9 A; 248/58, 62, 67.7, 612, 617, 416

[56] References Cited

U.S. PATENT DOCUMENTS

| | | | |
|---|---|---|---|
| 1,891,796 | 12/1932 | Carder | 98/43 |
| 2,164,608 | 7/1939 | Cornelius | 98/33 R |
| 2,828,682 | 4/1958 | Marker | 98/43 |
| 2,972,941 | 2/1961 | Bennett | 98/101 |
| 3,132,578 | 11/1961 | Sherron | 98/39 |
| 3,204,546 | 10/1963 | Krell | 98/39 |
| 3,627,248 | 12/1971 | Nelson | 248/309 |
| 3,785,271 | 1/1974 | Joy | 98/43 R |
| 3,846,043 | 11/1974 | Wolbrink et al. | 416/183 |
| 3,895,568 | 7/1975 | Stone | 98/43 |
| 4,006,672 | 2/1977 | Matsuyoshi et al. | 98/39 |
| 4,048,911 | 9/1977 | Petersen | 98/39 |
| 4,073,597 | 2/1978 | Barnhart et al. | 415/201 |

FOREIGN PATENT DOCUMENTS 611159 10/1948 United Kingdom .

OTHER PUBLICATIONS

Broan Catalogue, Home Ventilating Fans and Heaters, 1979, pp. 2 and 3.

*Primary Examiner*—Albert J. Makay
*Assistant Examiner*—Henry Bennett
*Attorney, Agent, or Firm*—James W. Grace; Charles W. Vanecek

[57] ABSTRACT

A fan housing assembly includes a fan and an air permeable, decorative grill mounted on a U-shaped bracket in a housing and two rotatably mounted, semi-circular damper plates in said housing, said plates being movable by air blown by said fan between a normal horizontal position blocking the air discharge opening of said housing and a vertical position not blocking said opening; and a mounting device for said housing, said mounting device being rigidly affixed to a support member and being adapted to extend through an opening in the wall of said housing for engagement with and support of said housing.

16 Claims, 10 Drawing Figures

FIG. 4
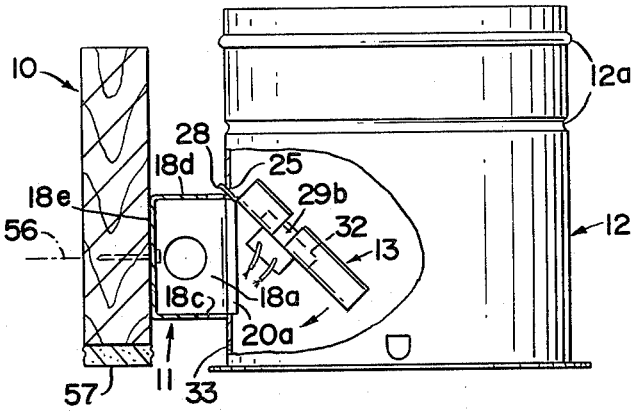
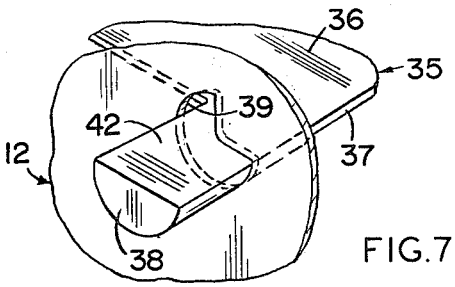
FIG. 7
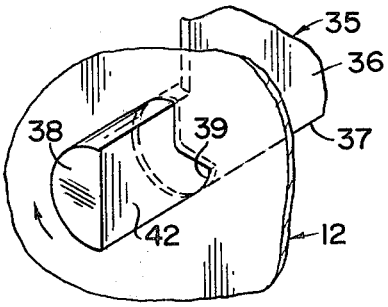
FIG. 8
FIG. 5
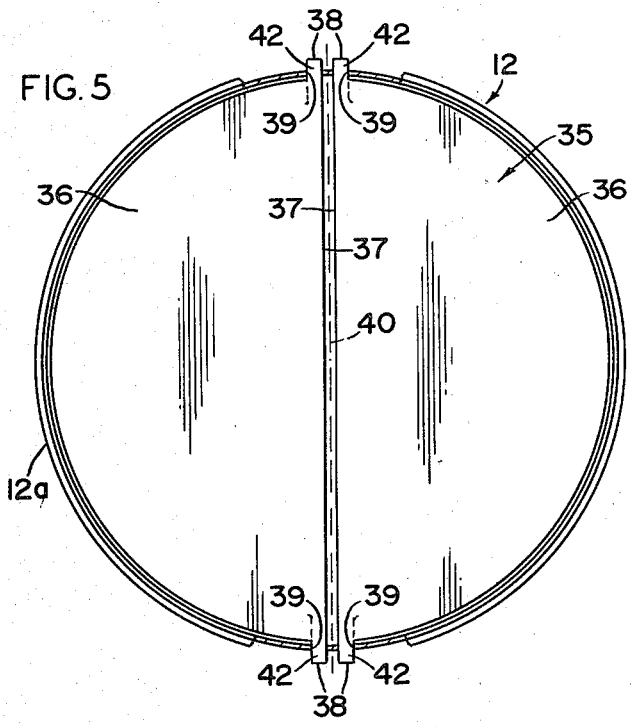
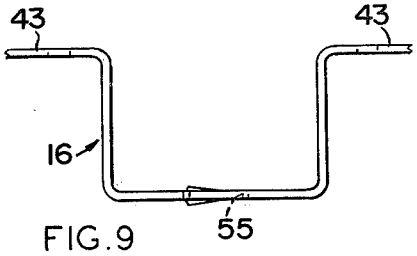
FIG. 9
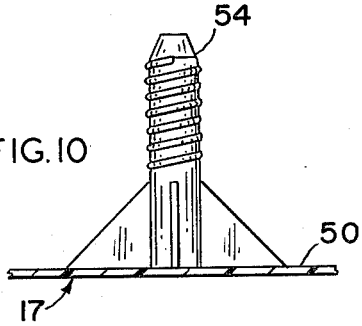
FIG. 10
FIG. 6
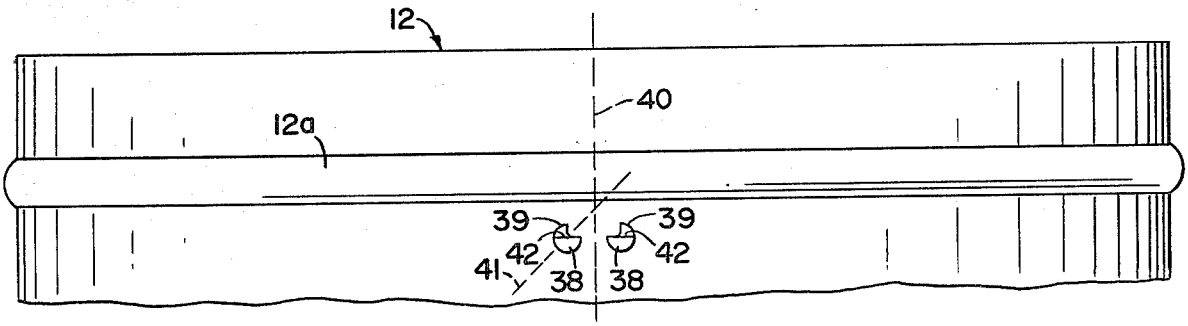

FAN HOUSING UNIT AND MOUNTING DEVICE THEREFOR

FIELD OF THE INVENTION

The invention relates to a fan housing assembly which finds particular utility in the field of exhaust fans. The fan housing assembly includes a housing having a damper, a ventilating fan and motor, and a decorative grill mounted therein, and a mounting means for said housing. The unit is especially well adapted for installation onto a ceiling joist of the enclosure from which air is to be discharged.

BACKGROUND OF THE INVENTION

A fan housing assembly is particularly useful in the field of exhaust fans which are enclosed in a metal or plastic box with an outlet valve and a grill covering the air intake face of the box.

Small exhaust fan assemblies, such as those used in a bathroom for the exhaustion of odors therefrom, are usually inexpensively made. The entire assembly, including the fan and housing, must be simple to make and easy to install. In addition, because the fan may be removed from time to time, it is necessary to provide for easy disassembly of a portion of the system to permit access to the fan for ready attention or service. All of these features must be available in a relatively inexpensive device.

Because of the nature of the exhaust fan assembly, it must be manufactured with as few intricate steps as possible out of simple, commonly available sheet metal or other suitable material. The parts must be easily stamped and formed. A minimum number of parts must be utilized so that the installation and accessability of the assembly is as simple as possible.

While the fan housing assembly is most commonly made of metal, it may also be made of suitable plastic material, if desired.

OBJECTS OF THE INVENTION

It is an object of the present invention to provide an improved fan housing assembly which is simple to manufacture and easy to assemble and install.

It is a further object of the present invention to provide a mounting device for a ventilating fan unit which utilizes simple mounting means, with the result that the unit can be easily and quickly installed by the individual home owner on an accessible structure of the enclosure to be exhausted, such as a ceiling joist.

It is a yet further object of the present invention to provide a fan housing assembly which provides easy access to the interior of the fan housing assembly for cleaning and service.

It is another object of the invention to provide a fan housing assembly having an improved construction and arrangement of parts so as to provide a quiet damper operation.

It is still another object of the invention to provide a simple mounting means by which a decorative grill may be secured to the ventilating fan assembly to hide the interior thereof and thereby enhance the appearance of the unit.

These and other objects of the invention will become more apparent as the description thereof proceeds.

SUMMARY OF THE INVENTION

The above objects were achieved in the ventilating fan housing assembly of the invention comprising a fan housing and a mounting element therefor, said housing providing a channel for the passage of air therethrough from the enclosure to be exhausted to the outside of the housing and being equipped with (a) a blower means for moving the air therethrough, (b) an air-permeable decorative grill covering the air intake opening of said housing, (c) a single support for both said blower means and said decorative grill, and (d) a damper member mounted for movement between a first position blocking the air discharge opening of said housing and a second position not blocking said air discharge opening, said damper member being normally biased to said first, blocking position and being movable by air blown through said housing to said second nonblocking position.

This invention provides an exhaust fan housing assembly which is simple to manufacture, easy to install and whose interior is readily accessible for cleaning and maintenance. The ease of installation of the fan housing is a particularly advantageous feature of the invention and is achieved through use of a special mounting device which is adapted to be secured both to an accessible supporting structure of the enclosure being exhausted, such as a ceiling joist or studding, and to the fan housing. The mounting device includes a base plate and two laterally spaced, resilient support arms outwardly projecting from said base plate and adapted to extend through an opening provided in the wall of the fan housing for engagement with and for supporting the fan housing assembly. The base plate is rigidly affixed to the support structure by any suitable fastening means, such as screws or nails. The support arms are capable of being flexed sideways and their outer free edges terminate in flanges angled outwardly from each other. The dimensions of the two support arms and the spacing between them and the size of the opening in the wall of the fan housing are such to permit the insertion of the flanged ends of both support arms through said opening, whereby the angled flanges of said support arms become positioned directly against the two laterally opposed inner surfaces of said fan housing adjacent said opening and said fan housing is supported by said support arms. The mounting device of the invention preferably comprises a generally rectangular box-like structure with side walls, a top wall, a bottom wall, a back wall, and an open side, said back wall being affixed to an accessible ceiling joist and said side walls functioning as the support arms for the fan housing. The mounting device can further serve as a housing for electrical connections to the fan housing assembly. A cover plate having an electrical outlet mounted thereon may be attached to the inner surface of the fan housing wall so as to cover the mounting opening of the fan housing.

The fan housing of the invention preferably comprises a generally cylindrical casing defining a chamber for the passage of air therethrough and having a mounting openig in the casing wall. A motor carrying a fan is mounted inside the chamber, with the fan located so as to be concentric with the circumference of the chamber. The casing is vertically positioned on the mounting device so that air is drawn upwardly through its bottom opening and is discharged through its top opening.

Another advantageous feature of the fan housing assembly of the present invention is that the support member for the motor and fan is additionally utilizable to secure a decorative grill over the bottom or air intake opening of the casing. For this purpose the present invention provides a mounting strip which is suitably attached in the lower portion of the casing and extends transverse to its longitudinal axis. The mounting strip is preferably a U-shaped bracket, the central valley portion of which projects downwardly toward the air intake opening of the casing and has an aperture formed therein for receiving and securely engaging an upstanding projection of the decorative grill.

The casing of the present invention also houses inside its upper portion and above the motor and fan a damper which is hingedly mounted for movement between a horizontal closed position and a vertical open position, said damper being normally biased to said closed position. The damper is mounted such that when an upward airflow is caused to bear against the underside of said damper, it will assume a generally vertical open position, and when the direction of airflow is reversed or the airflow discontinued, then the damper will naturally return to its normal horizontal closed position. Preferably, the damper comprises two semicircular plates having their straight edges adjacent one another. Each plate is hingedly mounted in the generally horizontal position inside the casing by means of semicircular tabs projecting from the two opposite ends of its straight edge through two crescent-shaped apertures in the casing wall.

DESCRIPTION OF THE DRAWINGS

In the drawings:

FIG. 4 is a side elevational view of the fan housing of FIG. 3 mounted on the junction box with a part of the fan housing broken away to show a cover plate being rotated into position inside the fan housing;

FIG. 5 is an enlarged top plan view of the damper plates shown in FIG. 1 in the closed position;

FIG. 6 is an enlarged side sectional view of the upper portion of the fan housing of the invention showing the ears of the damper plates in the closed position protruding through apertures in the fan housing wall;

FIG. 7 is an enlarged fragmentary perspective view of the fan housing wall aperture with protruding damper plate ear shown to the left in FIG. 6 (in the closed position);

FIG. 8 is an enlarged fragmentary perspective view of the fan housing wall aperture with protruding damper plate ear of FIG. 7 but in the open position;

FIG. 9 is an enlarged fragmentary side view of the downwardly projecting portion of the bracket shown in FIG. 1;

FIG. 10 is an enlarged fragmentary side view of the decorative grill shown in FIG. 1, with a part broken away to show an upstanding threaded stud.

DETAILED DESCRIPTION OF THE INVENTION

Figure 1:
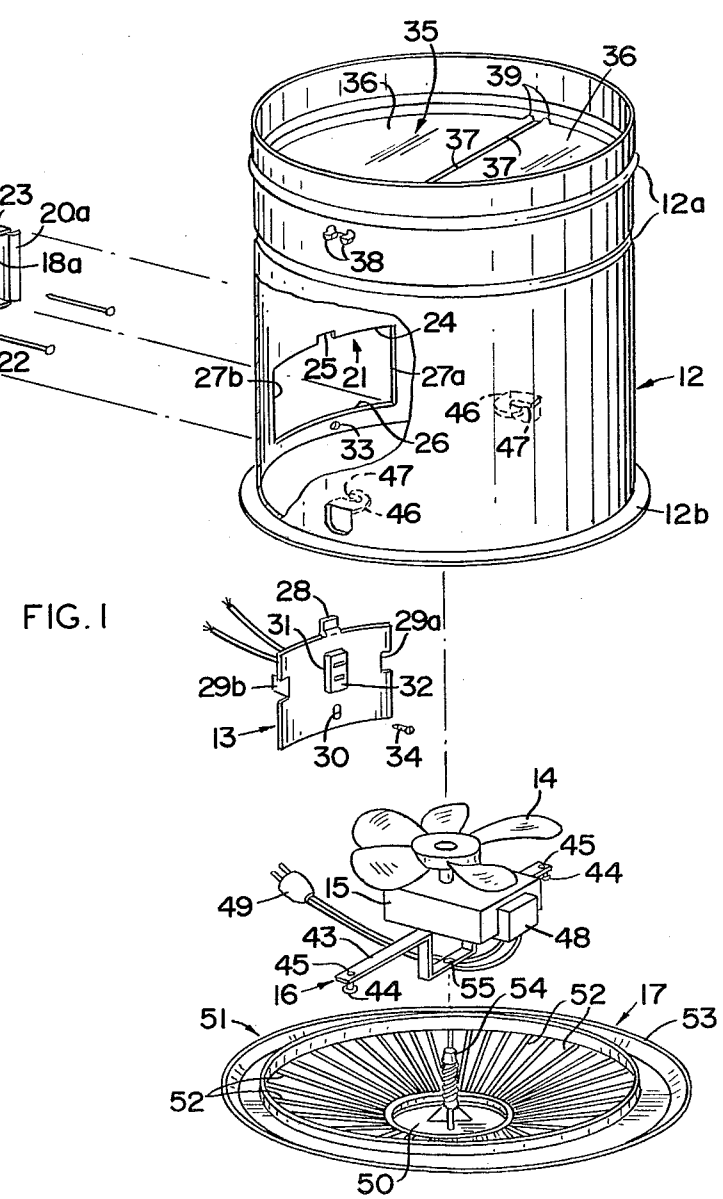
FIG. 1 is an exploded perspective view of a ventilating fan assembly embodying the features of the present invention.

This invention will be described as embodied in a ventilating fan assembly constructed with the arrangement of the parts as illustrated in FIG. 1. It is to be understood, however, that the dimensions, arrangement, and assembly of the parts shown in this typical example could be changed in various ways, and the concept of the invention would still be effective in providing an improved ventilating apparatus distinguished by its means for installation and securing of a ventilator fan; for retention of the damper member and for limiting rotation of the same; and for retention of the decorative grill.

Referring now to the drawings in greater detail wherein like numerals have been employed throughout the various views to designate similar components, FIG. 1 shows at the top from left to right, a joist 10, a junction box 11, and a fan housing 12; and from top to bottom below the fan housing, a junction box cover plate 13, a fan 14 and motor 15 mounted on a bracket 16, and a decorative grill 17.

The junction box or mounting member 11 (see FIGS. 1 and 2) provides the means for securely fastening the fan housing 12 to a joist 10 or other accessible supporting structure in the ceiling of the enclosure to be ventilated. The junction box can also serve as a housing for electrical connections for the fan housing assembly of the invention.

Figure 2:
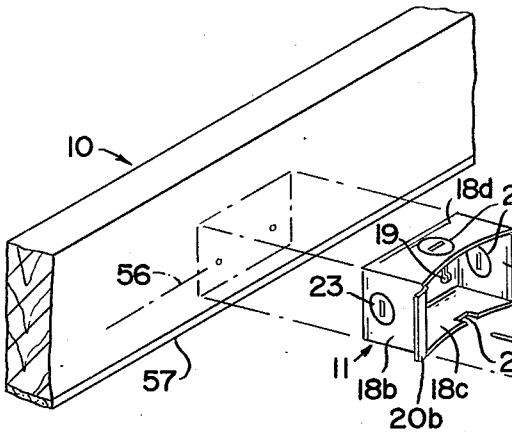
FIG. 2 is an enlarged perspective view of the junction box shown in FIG. 1.
Figure 2:
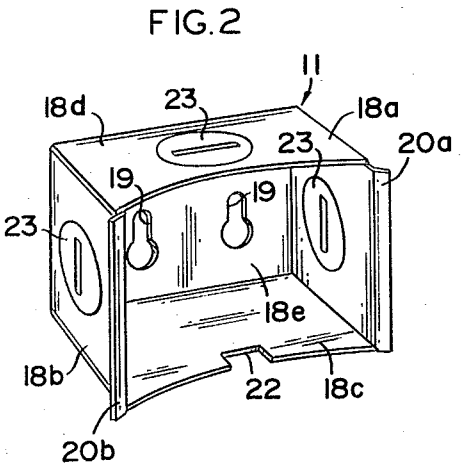

Junction box 11 comprises a generally rectangular box-like structure with sides 18*a*, 18*b*, a bottom wall 18*c*, a top wall 18*d*, a back wall 18*e*, and an open side. The junction box may be made from any suitable material, such as sheet metal or a strong molded plastic. For example, box 11 may be made of sheet metal of approximately 0.032 gauge thickness. This box is adapted to be supported on joist 10 by any suitable means fastening back wall 18*e* to the joist. For this purpose, back wall 18*e* can be provided with two apertures or key hole slots 19 as shown in FIGS. 1 and 2. By driving fasteners, such as screws or nails, through the key hole slots and into the joist or studding, the junction box is secured in place. When the junction box is thus rigidly affixed to ceiling joist 10, its top, bottom and side walls project outwardly from the joist, the top and bottom walls lying in a generally horizontal plane and the side walls lying in a generally vertical one.

In the advantageous configuration of junction box 11 shown in FIGS. 1 and 2, each of its outwardly projecting walls merges integrally with and is bent forward from back wall 18*e* but the side walls 18*a*, 18*b* are not attached to the top and bottom ones. This configuration can be obtained in known manner from a single piece of sheet metal, folded to the desired shape. The junction box is also conveniently designed so that, after its installation on the joist, the upper edges of the side walls are somewhat below the horizontal plane defined by top wall 18*d* and the lower edges of the side walls are somewhat above the horizontal plane defined by bottom wall 18*c*. This configuration can be achieved by bending the top and bottom walls slightly less than 90° from the plane of back wall 18*e*. The side walls can thus be flexed sideways somewhat without touching the top and bottom walls. These design features contribute to ease of installation of fan housing 12 onto junction box 11, as will be explained below.

The outermost edges of the four projecting walls of junction box 11 are each approximately designed for ready engagement of fan housing 12 with the mounted junction box. Side walls 18*a*, 18*b*, are capable of limited sidewise flexing and their outermost free edges terminate in outwardly directed flanges 20*a*, 20*b* adapted to abut against the inner surface of the fan housing after appropriate mounting of the latter. For this purpose flanges 20*a*, 20*b* are bent outwardly from each other and are dimensioned for insertion into a mounting opening 21 in the wall of the fan housing (see below). Also, the outermost edges of top wall 18*d* and of bottom wall 18*c* of the junction box are curved to accommodate the curved outer surface of fan housing 12.

A small recess 22 is located along the curved outer edge of bottom wall 18*c*. This recess provides a place of attachment on the junction box for a ground clip (not shown) into which a ground wire can be inserted. Circular raised knockout panels or disks 23, having small, centrally located, rectangular slits, form a part of top wall 18*d* and side walls 18*a*, 18*b*. These panels or disks are attached to the respective walls by two spaced, easily breakable spot welds or bridges located on their periphery, which facilitates their removal by placement of the blade of a screwdriver through the slit in the panel and subsequent twisting of the screwdriver. Electrical wiring from the fan housing assembly can be routed through the opening thus obtained for connection to a source of electrical power.

In accordance with the present invention, a ventilation fan housing, in which are installed blower and damper means, is mounted on junction box 11. As is shown in FIG. 1, fan housing 12 advantageously comprises a generally cylindrical casing which has an opening 21 to permit installation of the casing onto junction box 11. The casing may be fabricated from any suitable material, as, e.g., sheet metal or molded plastic. It can be formed from a thin rectangular piece of sheet metal, a small rectangular section of which is cut out to provide opening 21. Formation of the cylindrical casing from the rectangular piece of sheet metal is easily accomplished in a known manner, as, e.g., by forming the rectangular sheet into a rounded casing with overlapping edges and then spot welding these edges together. As shown in FIG. 1, casing 12 is strengthened by reinforcing ribs 12*a* and by an outwardly projecting circumferential lip 12*b* around its lower circular edge.

Figure 3:
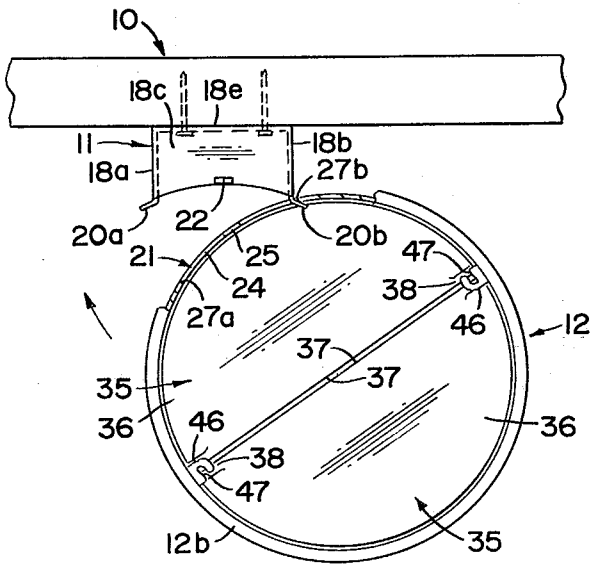
FIG. 3 is a bottom plan view of a fan housing being rotated into position onto the junction box of FIG. 2.

Four-sided mounting opening 21 of the casing is bounded by top edge 24 with cutout 25, bottom edge 26 and side edges 27*a*, 27*b*. The opening is of such size as to accommodate the insertion of flanges 20*a*, 20*b* of both side walls of the junction box within the casing in the mounting step. The vertical distance between top edge 24 and bottom edge 26 of the opening is preferably slightly less than the vertical distance between the outermost edges of top wall 18*d* and bottom wall 18*c* of the junction box. Cutout 25 is sized so that, after mounting of casing 12 on junction box 11, an opening is provided between the casing wall and top wall 18*d* of the junction box for the insertion therethrough of tab 28 of cover plate 13 (see below). Briefly, the mounting of the casing in accordance with the present invention can be described as follows:

As illustrated in FIG. 3, the first step in the mounting procedure is to insert one side flange of the junction box, e.g., flange 20*b*, through opening 21 so as to locate this flange inside casing 12. Sides 18*a*, 18*b* of junction box 11 are then squeezed toward each other and casing 12 is rotated toward the junction box (in the direction shown by the arrow in FIG. 3). Sides 18*a*, 18*b* are squeezed together to the extent that the other side flange (20*a*) comes within casing 12 before the rotational movement of the casing is stopped against the junction box top and bottom walls. Finally, the pressure on side walls 18*a*, 18*b* is released, whereby these side walls spring apart and flanges 20*a*, 20*b* come to positions abutting the respective laterally opposed inner surfaces of the casing wall adjacent edges 27*a*, 27*b* thereof.

After the fan housing is mounted as outlined above, a cover plate 13 (see FIG. 1) can be attached to the inner surface of the casing wall so as to cover mounting opening 21. Cover plate 13 may be made from any suitable material and advantageously comprises a thin plate bent from a generally rectangular piece of sheet metal so as to accommodate the concave curvature of the inner surface of the casing wall against which it is seated. After the cover plate is mounted against the casing wall, its front face shown in FIG. 1 is exposed to view from inside the casing. Centrallly located along the top edge of cover plate 13 is an integral tab 28 which slopes backward from the front face of the plate a very short distance and terminates in a small upwardly directed portion. Cover plate 13 also has two integral, backwardly projecting tabs or ears 29*a*, 29*b*. Each of these two projections is formed by bending backward a small rectangular section of the cover plate along its side edge. The lateral spacing between tabs 29*a*, 29*b* is such that, after mounting of the cover plate against the casing wall, these tabs fit snugly within the junction box and press outwardly side walls 18*a*, 18*b*, respectively, of the junction box. Plate 13 is provided with a hole 30 near its lower edge to accommodate a fastener for securing the plate to the casing wall. Another aperture 31 is provided in plate 13 between upper tab 28 and hole 30. An electrical outlet 32 having leads to a source of electrical power can be mounted by conventional means in opening 31.

FIG. 4 shows the installation of cover plate 13 over opening 21 in the casing wall. Plate 13, having electrical outlet 32 and its wire connections attached thereto, is positioned at an angle to the inner casing wall adjacent opening 21 and tab 28 of the plate is inserted into slot 25 along the top edge of the junction box. Using the engaged tab and slot as a pivotal point, cover plate 13 is then rotated clockwise downwardly (in the direction shown by the arrow in FIG. 4) to a generally vertical position against the mounted casing wall. Ears 29*a*, 29*b* of the cover plate are thereby brought within junction box 11 and are caused to slip against the inside surfaces of side walls 18*a*, 18*b*, respectively, of the junction box, thus forcing the outer ends of the side walls (from the joist) in a laterally outward direction. A hole 33 (see FIG. 1) is located in the casing wall below opening 21 thereof so as to provide, together with hole 30 of the cover plate, an opening to permit a fastener, such as a small metal screw 34, to enter to hold cover plate 13 against the mounted fan housing. Hole 33 can be variously adapted to secure the fastener in place. For example, the hole can be extruded, punched, nail punched, etc. in the casing wall, and a thread forming screw used to attach the cover plate to the mounted fan housing. Or hole 33 can be formed with internal threading for engagement with a fastening screw. With the insertion of screw 34 to hold the cover plate in place, the fan housing of the invention is securely held to the junction box and ready for the final installation steps, including mounting of the motor blade assembly and the decorative grill and appropriate ducting to the exterior of the enclosure.

In practice, the fan housing of the invention, which is installed in accordance with the above-described procedures, has its improved damper structure already mounted therein at the time of the installation. As illustrated in FIG. 1, damper 35 is mounted in the upper portion of casing 12. It can be formed of any suitable material but is preferably molded of a plastic material such as 40% talc filled polypropylene. The molded plastic advantageously has a high strength to weight ratio. Damper 35, in the horizontal position shown in FIGS. 1 and 5, serves to close the upper air discharge opening of casing 12 to the passage of air therethrough. It is hingedly mounted for movement between this horizontal closed position and a vertical open position, being normally biased to the closed position.

The present invention provides a particularly advantageous means of securing a ventilator damper in its closed position and of controlling its rotational movement between open and closed positions. To accomplish these purposes the damper structure of the invention includes projections therefrom which are adapted to be received in apertures provided in the wall of the fan housing. The damper projections and the cooperating housing apertures are so shaped and dimensioned that the damper structure is thereby normally biased into the horizontal closed position and, when the blower means is operated, is capable of only a limited rotational movement to the open position.

Preferably, damper 35 comprises two semicircular plates 36, each having a diagonal straight edge 37, which is provided with an integral, semi-circular half-cylindrical tab or ear 38 projecting from each end thereof for cooperation with a hinging aperture 39 provided in casing 12 (see FIGS. 5–8). Hence, there are four ears 38 and four hinging apertures 39. The normal closed position of the damper would find the two pivotable plates 36 in a generally horizontal position with straight edges 37 closely adjacent one another over their entire length and ears 38 extending through opposing apertures 39 in the wall of casing 12, as is seen in FIG. 5. The upper surface of each damper palte 36, including the upper surfaces of its two ears 38, is flat. Each plate's lower surface is also flat except for two slightly raised portions adjacent the ends of its diagonal straight edge, said raised portions terminating in the solid half-cylindrical ears 38 (see FIGS. 3 and 6–8).

Apertures 39 in the casing wall are shaped and dimensioned to receive the small, damper ears 38 which project therethrough to the outside of casing 12. As can be seen in FIGS. 5 and 6, a closely spaced pair of apertures 39 is formed adjacent each of two diametrically opposing locations in the wall of casing 12. The apertures of each pair are symmetrically disposed about the diametrical plane 40 through the casing (indicated by the broken line in FIGS. 5 and 6). Preferably, apertures 39 are not fully circular holes, which advantageously have a generally convexo-concave or crescent shape. The axis of curvature of each convexo-concave opening 39 (shown by the broken line 41 for one aperture 39 in FIG. 6) projects upwardly from the horizontal toward the diametrical plane 40. Each crescent-shaped opening 39 is oriented in this way so that the respective half-cylindrical ear 38 projecting therethrough is thereby supported in the closed position with its flat diametrical surface 42 in a generally horizontal position (See FIG. 7) and is movable with the opening from said closed position to the open position wherein said diametrical surface 42 assumes a more or less vertical position (see FIG. 8). Through this arrangement, the two ears of each damper plate 36 serve to support the damper plate in its horizontal position, with the curved surface of each ear 38 resting on the lower curved edge of the cooperating aperture 39 and the concave edge of the aperture projecting somewhat over the flat diametrical surface 42 of the ear, as can be seen in FIGS. 6 and 7. Each damper plate is prevented from rotating downward from the horizontal position by the closely abutting portions of the two concave edges of apertures 39 which project over its ears 38, as illustrated in FIG. 7 for one ear and its cooperating aperture. The shape of apertures 39 can be varied somewhat and the apertures will still function to effectively control the damper operation. The outer positions of their concave edges can, for example, be generally straight rather than curved. It is, of course, obvious that the parts can be reversed and the resulting arrangement of the tabs or ears and the apertures will still fall within the scope of the present invention. Thus, the tabs can be formed to project out from the casing and the cooperating apertures can be molded into the dampers.

When fan 14 is idle, damper plates 36 assume the closed position shown in FIGS. 1, 5 and 6. In this position, the damper plates close casing 12 and prevent back draft through the unit into the interior enclosure space. As seen in FIGS. 1, 5 and 6, damper plates 36 are normally biased into a closed position. When fan 14 is operated, each damper plate 36 rotates to a generally vertical open position, with its two ears 38 pivoting in apertures 39. This pivoting of damper ears 38 can better be understood by considering the rotation of one of said ears. FIG. 7 shows ear 38 (shown to the left in FIG. 6) in the closed position and the arrow in FIG. 8 shows the direction in which ear 38 rotates in going to the open position. FIG. 8 illustrates damper ear 38 at the point of the maximum upward travel of the damper plate (fully opened). It can be seen in FIG. 8 that further clockwise rotation of ear 38 and, accordingly, of the opening damper plate itself is prevented by the upper portion of the concave edge of aperture 39, which blockingly contacts the upper portion of vertically aligned surface 42 of the damper ear. The apertures 39 of each opposing set are so shaped in relation to the damper plate ears 38 received therein that the plate can rotate only within a prescribed arc to its maximum elevation and will fall by its own weight to the closed position when fan 14 is turned off or will return to the closed position when a sufficient back draft bears downward upon the upper surface of the plate.

In accordance with another aspect of the present invention, the ventilating fan assembly is provided with a single support for both the fan 14 and motor 15 assembly and decorative grill 17. In practice, the support and fan and motor assembly are installed in casing 12 after the latter has been mounted on junction box 11 and the cover plate 13 has been secured in place. Then, after the ventilating fan assembly has been connected, via suitable ductwork, to the outside of the enclosure to be exhausted, and the ceiling surface surrounding the air intake opening of the unit has been finished, installation of the unit is completed by covering the air intake opening with grill 17.

The blower assembly, consisting of a fan 14 and an electric motor 15, is coaxially supported within casing 12 on rigid mounting support 16, which extends diametrically across the inside of casing 12 and is secured to the casing wall in any suitable manner. The exploded view in FIG. 1 shows the blower assembly, which is mounted by conventional means to support 16, below casing 12. Mounting support 16 preferably comprises an upwardly directed U-shaped metal strip with the portions of its legs that are distal from the U's bight extending laterally outward from each other to form two supporting arms 43 of equal length. (See FIGS. 1 and 9). Mounting support 16 is advantageously so constructed that, after installation within the lower portion of casing 12, its central, horizontally disposed bight portion is located immediately inside the air intake opening of the casing. Preferably, mounting support 16 is removably secured to casing 12 to facilitate removal of the fan and motor, if necessary. This is done by means of two screws 44 which pass through suitable threaded openings 45 at the ends of arms 43 to engage diametrically opposing mounting brackets 46, which are positioned near the lower ends of the casing wall. Mounting brackets 46, which may be struck out of the material of the casing, comprise laterally extending flanges which project inwardly toward each other from the casing wall.

In order to facilitate the fastening of support 16 to mounting brackets 46, appropriately spaced screw slots 47 are formed through mounting brackets 46. Thus, in the mounting of the blower assembly onto casing 12, screws are placed in both openings 45 of support 16, on which the fan and motor assembly has previously been mounted in any suitable manner. The screws are inserted so that the screw heads are positioned on the side of support 16 opposite to the fan and motor. Then the whole assembly of the fan 14, motor 15, and support 16 is inserted upward into the interior of casing 12 and is positioned with the fan and motor being located above the support and the coil 48 of the motor being placed to the side opposite cover plate 13 within the casing. Fan 14 is thereby located in the upper portion of casing 12 below dampers 36. The assembly is secured in place by positioning the ends of support 16 slightly above and to the sides of slotted tabs 46 and then rotating support 16 to engage screws 44 into slots 47 and finally tightening the screws. Electric plug 49 from motor 15 is next passed under support 16 and inserted into electrical outlet 32.

Subsequent to installation of the blower assembly within casing 12, as described above, the ventilator is connected to the outside of the dwelling by means of suitable ductwork. Care must be taken in this operation that nothing touches the small damper hinge tabs 38 projecting out through casing 12 so as to ensure that dampers 36 will rotate freely during subsequent operation of the ventilator. After suitable ducting of the ventilator, the surrounding drywall or ceiling surface is completed.

In accordance with the present invention, grill 17 is detachably secured to mounting support 16 to cover the air intake opening of casing 12. Grill 17, which is preferably molded from plastic, can have many suitable configurations. As shown in FIG. 1, grill 17 is preferably fashioned with a central circular plate-like section or hub 50, which is integrally connected to an annular rim 51 by a plurality of circumferentially spaced, spoke-like elements or blades 52. Adjacent blades 52 are spaced from each other providing a plurality of open channels for the passage of air upwardly into casing 12. The inner periphery of rim 51 has a circular upturned edge which is dimensioned to fit closely within casing 12 after appropriate mounting of grill 17. A peripherally continuous outwardly and upwardly directed sealing flange 53 extends around the outer periphery of rim 51 and seals against the ceiling when the grill is installed.

Grill 17 is mounted to mounting support 16 by means of a vertical shaft or stud 64, which projects upwardly from the grill and passes through and is gripped in an opening 55 in the mounting support. The upwardly projecting stud and cooperating gripping aperture can be variously designed to detachably engage the grill with the mounting support. For example, stud 54 can be threaded or unthreaded. Likewise, opening 55 can have a threaded or unthreaded configuration, such as a split tapered arrangement (see below).

As illustrated in FIGS. 1 and 10, stud 54 of grill 17 is preferably threaded, with a slightly tapered upper portion. Stud 54 is centrally located and advantageously directly molded on hub 50 of the grill and has an upright axis that coincides with the central axis of casing 12. The stud is dimensioned to screw into opening 55 of mounting support 16 and to be securely gripped by the mounting support edge defining opening 55.

Opening 55 is centrally located in the bight or connecting web of U-shaped metal bracket 16, as shown in FIGS. 1 and 9. Opening 55 preferably comprises a generally circular split tapered hole adapted to receive and grippingly engage stud 54 of the grill. The opening's split tapered configuration is obtained by forming two adjoining oppositely directed edges along the circumference of opening 55, one of which is bent slightly upward from the horizontal plane of the bight and the other of which is bent slightly downward from said horizontal plane (see FIGS. 1 and 9).

Grill 17 is mounted by inserting the tapered upper end of stud 54 into opening 55 and then rotating the grill clockwise, whereby stud 54 is threaded through opening 55. The threading is continued until flange 53 of the grill is brought into sealing engagement with the ceiling of the enclosure. The grill is thereby retained securely in place and the complete ventilator assembly is ready for operation.

The ventilator unit of the present invention is especially designed for through the ceiling installation in new or existing construction with accessible ceiling joists. As illustrated in FIGS. 1 and 4, a horizontal line 56 is suitably located some distance up from the bottom of finished ceiling surface 57. Horizontal line 56 is located one and three-quarters inches up from the bottom in the assembly shown in FIG. 1. An appropriate location on the joist to mount junction box 11 is then chosen, the mounting screws (or nails) for the junction box being insertable on horizontal line 56. After the appropriate knockout 23 on the junction box has been removed for the routing of electrical wiring from the ventilator unit to a power source, two wood screws or drywall nails can be used to secure the junction box to the joist. The casing 12 can next be secured to the junction box and the cover plate 13 installed in place, as described above. All necessary wire connections are made in a conventional manner. With casing 12 thus secured to the joist, the motor and fan assembly and the decorative grill are mounted thereon in accordance with the above description to complete the installation.

To clean the unit, it is merely necessary to remove the decorative grill by unscrewing the same from the hole in the support bracket. The motor/fan/support bracket assembly can then be easily disengaged from the casing for cleaning and maintenance. Reassembly is as previously described.

Whereas the present invention has been described with respect to a specific embodiment thereof, it should be understood that the invention is not limited thereto as many modifications thereof may be made. It is therefore contemplated to cover by the present application any and all such modifications as fall within the true spirit and scope of the appended claims.

We claim:

1. A fan housing assembly for attachment to a supporting structure of an enclosure to be exhausted comprising:

(a) a fan housing comprising a generally cylindrical hollow casing which includes openings at its two ends and means securing said casing to said supporting structure, said casing being vertically positioned on said supporting structure, with the opening at its lower end serving as an air intake opening and the opening at its upper end serving as an air discharge opening, (b) a blower means for drawing air from said enclosure and blowing the same through said casing to the outside thereof, (c) an air permeable, decorative grill covering said air intake opening of said casing, (d) support means for said blower means and said decorative grill, and (e) a damper member comprising two semicircular plates having their straight edges closely adjacent one another and disposed to either side of a diametrical plane through said casing, each of said plates being rotatably mounted in the top portion of said casing by means of two half-cylindrical tabs projecting from the two opposite ends of its straight edge through cooperating apertures in said casing wall, said cooperating apertures being not fully circular holes, said plates being supported in a generally horizontal position blocking said air discharge opening of said casing with the flat diametrical surface of each of said tabs in a generally horizontal position, and being rotatable by air blown through said casing to a generally vertical position not blocking said air discharge opening, wherein said flat surface of each of said tabs assumes a generally vertical position, said plates being normally biased to said generally horizontal blocking position.

2. A fan housing assembly for attachment to a supporting structure of an enclosure to be exhausted comprising:

I. (a) a generally cylindrical hollow casing which includes openings at its two ends and an intermediate generally rectangular mounting opening in the casing wall adapted to receive a mounting element, said casing being vertically positioned on said mounting element, with the opening at its lower end serving as an air intake opening and the opening at its upper end serving as an air discharge opening, (b) a blower means for drawing air from said enclosure and blowing the same through said casing to the outside thereof, (c) an air permeable, decorative grill covering said air intake opening of said casing, (d) support means for said blower means and said decorative grill, and (e) a damper member mounted for movement between a first position blocking said air discharge opening of said casing and a second position not blocking said air discharge opening, said damper member being normally biased to said first, blocking position and being movable by air blown through said casing to said second, nonblocking position;

II. a mounting element comprising a generally rectangular box-like structure having a back wall and a top, bottom and side walls projecting from said back wall, said back wall being rigidly affixed to said supporting structure of said enclosure and said side walls being spaced and dimensioned to extend through said mounting opening in said casing wall for engagement with and support of said casing, wherein (a) the projecting walls are integrally connected to said back wall, (b) the outer free ends of said side walls terminate in flanges angled outwardly from each other, said outer free ends being capable of being squeezed inward toward each other and of springing back to their original positions for insertion into said mounting opening in said casing wall and engagement with said casing, whereby the angled flanges of said side walls become positioned directly against the laterally opposed inner surfaces of said casing wall adjacent said mounting opening, and (c) the outermost edges of said top and bottom walls are curved to accommodate the curved outer surface of said casing wall; and III. a cover member curved to seat against the inner surface of the mounted casing wall, said cover member being attached to said inner surface and being dimensioned to cover said mounting opening of said casing wall, said cover member comprising a four-sided curved plate, said plate having (a) an integral upper tab centrally located on its top edge, said tab projecting backward from the concave front face of said plate and terminating in an upwardly directed portion, (b) an integral lower tab located on each of the two side edges of said plate and projecting backward from said front face, the lateral spacing between said two lower tabs being such that, when said plate is mounted against said inner surface of said mounted casing wall, said lower tabs fit snugly within said mounting element and press outwardly its side walls, and (c) a hole adjacent the bottom edge of said plate; and said casing wall being provided with (i) a cutout along the edge defining the top side of said mounting opening, said cutout forming a receiving opening between said casing wall and said top wall of said mounting element for insertion therethrough of said upper tab of said plate, and (ii) a hole located below said mounting opening so that, when said upper tab of said plate is inserted in said receiving opening and said plate is rotated downward to a generally vertical position against said mounted casing wall, said casing hole becomes aligned with said hole in said plate and said plate is secured against said mounted casing wall by a fastener inserted through said aligned holes.

3. A fan housing assembly for attachment to a supporting structure of an enclosure to be exhausted comprising:

I. (a) a fan housing comprising a hollow, generally cylindrical casing which includes openings at its two ends and an intermediate mounting opening in the casing wall adapted to receive a mounting element, said casing being vertically positioned on said mounting element, with the opening at its lower end serving as an air intake opening and the opening at its upper end serving as an air discharge opening, (b) a blower means for drawing air from said enclosure and blowing the same through said casing to the outside thereof, (c) an air permeable, decorative grill covering said air intake opening of said casing, (d) support means for said blower means and said decorative grill, and (e) a damper member mounted for movement between a first position blocking said air discharge opening of said casing and a second position not blocking said air discharge opening, said damper member being normally biased to said first, blocking position and being movable by air blown through said casing to said second, nonblocking position, said damper member comprising two semicircular plates having their straight edges closely adjacent one another and disposed to either side of a diametrical plane through said casing, each of said plates being rotatably mounted in a generally horizontal, blocking position in the top portion of said casing by means of two tabs projecting from the two opposite ends of its straight edge through cooperating apertures in said casing wall, said tabs of each plate being half-cylindrical and said cooperatingapertures in said casing wall being not fully circular holes, whereby said each plate is supported in the generally horizontal position with the flat diametrical surface of each of its tabs in a generally horizontal position and is rotatable by air blown through said casing to a generally vertical position wherein said flat surface of each tab assumes a generally vertical position; and II. a mounting element rigidly affixed to said supporting structure and adapted to engage said mounting opening for attachment of said casing to said supporting structure.

4. A fan housing assembly for attachment to a supporting structure of an enclosure to be exhausted comprising:

I. (a) a generally cylindrical hollow casing which includes openings at its two ends and an intermediate generally rectangular mounting opening in the casing wall adapted to receive a mounting element, one of said end openings serving as an air intake opening and the other of said end openings serving as an air discharge opening, (b) a blower means for drawing air from said enclosure and blowing the same through said casing to the outside thereof, (c) an air permeable, decorative grill covering said air intake opening of said casing, (d) support means for said blower means and said decorative grill, and (e) a damper means mounted adjacent said air discharge opening and movable between a first position blocking said air discharge opening of said casing and a second position not blocking said air discharge opening;

II. a mounting element comprising a generally rectangular box-like structure having a back wall and a top, bottom and side walls projecting from said back wall, said back wall being rigidly affixed to said supporting structure of said enclosure and said side walls being spaced and dimensioned to extend through said mounting opening in said casing wall for engagement with and support of said casing, wherein (a) the projecting walls are integrally connected to said back wall, (b) the outer free ends of said side walls terminate in flanges angled outwardly from each other, said outer free ends being capable of being squeezed inward toward each other and of springing back to their original positions for insertion into said mounting opening in said casing wall and engagement with said casing, whereby the angled flanges of said side walls become positioned directly against the laterally opposed inner surfaces of said casing wall adjacent said mounting opening, and (c) the outermost edges of said top and bottom walls are curved to accommodate the curved outer surface of said casing wall; and III. a cover member curved to seat against the inner surface of the mounted casing wall and dimensioned to cover said mounting opening of said casing wall, said cover member comprising a four-sided curved plate, said plate having (a) an integral upper tab centrally located on its top edge, said tab projecting backward from the concave front face of said plate and terminating in an upwardly directed portion, (b) two integral lower tabs formed by bending backward from said front face of said plate two rectangular sections of said plate along its side edges, the lateral spacing between said two lower tabs being such that, when said plate is mounted against said inner surface of said mounted casing wall, said lower tabs fit snugly within said mounting element and press outwardly its side walls, and (c) a hole adjacent the bottom edge of said plate; and said casing wall being provided with (i) a cutout along the edge defining the top side of said mounting opening, said cutout forming a receiving opening between said casing wall and said top wall of said mounting element for insertion therethrough of said upper tab of said plate, and (ii) a hole located below said mounting opening so that, when said upper tab of said plate is inserted in said receiving opening and said plate is rotated downward to a generally vertical position against said mounted casing wall, said casing hole becomes aligned with said hole in said plate and said plate is secured against said mounted casing wall by a fastener inserted through said aligned holes.

5. The fan housing assembly of claim 2 wherein the lower tabs of the plate are formed by bending backward from the front face of said plate two rectangular sections of said plate along its side edges.

6. The fan housing assembly of claim 5 wherein the mounting element is provided with (a) a recess located along the curved outer edge of the bottom wall for attachment thereto of a ground clip, and (b) a knockout panel located in each of the top and side walls, whereby electrical wiring can be routed through an opening obtained by removal of one of said knockout panels, and the plate is provided with an aperture for mounting therein of an electrical outlet having leads to a source of electrical power.

7. The fan housing assembly of claim 4 wherein each of the cooperating apertures is a generally convexo-concave shaped opening, the axis of curvature of each of said openings projecting upwardly from the horizontal plane toward the diametrical plane of the casing extending between the apertures of each pair thereof.

8. The fan housing assembly of claim 7 wherein the damper plates are molded of a plastic material.

9. A fan housing assembly for attachment to a supporting structure of an enclosure to be exhausted comprising:

I. (a) a generally cylindrical casing which includes openings at its two ends and an intermediate generally rectangular mounting opening in the casing wall adapted to receive a mounting element, said casing being vertically positioned on said mounting element, with the opening at its lower end serving as an air intake opening and the opening at its upper end serving as an air discharge opening, (b) a blower means for drawing air from said enclosure and blowing the same through said casing to the outside thereof, (c) an air permeable, decorative grill covering said air intake opening of said casing, (d) a single support means for said blower means and said decorative grill comprising an upwardly directed U-shaped rigid strip extending diametrically across the inside of said casing, the portions of the legs of said strip that are distal from the U's bight extending laterally outward from each other to form two supporting arms of equal length and the termini of said arms engaging with diametrically opposing mounting brackets of said casing wall for support of said strip, with blower means mounted on the upper surface of said strip and the decorative grill detachably secured to said strip by means of a vertical stud which projects upwardly from the center of said grill and passes through and is gripped by a centrally located opening in the bight of said U-shaped strip, and (e) a damper member comprising two semicircular plates having their straight edges closely adjacent one another and disposed to either side of a diametrical plane through said casing, each of said plates being rotatably mounted in the top portion of said casing by means of two tabs projecting from the two opposite ends of its straight edge through cooperating apertures in said casing wall, wherein said plates are movable between a generally horizontal position blocking said air discharge opening of said casing and a generally vertical position not blocking said air discharge opening, said plates being normally biased to said blocking position and being movable by air blown through said casing to said nonblocking position; and II. a mounting element comprising a base plate and two laterally spaced support arms outwardly projecting from said base plate, said base plate being rigidly affixed to said supporting structure of the enclosure and said support arms being spaced and dimensioned to extend through said mounting opening in the casing wall for engagement with and support of said casing.

10. The fan housing assembly of claim 9 wherein the mounting element comprises a generally rectangular box-like structure having a back wall and a top, bottom, and side walls projecting from said back wall, said back wall functioning as the base plate and said side walls functioning as the support arms wherein (a) the projecting walls are integrally connected to the back wall, (b) the outer free ends of the side walls terminate in flanges angled outwardly from each other, said outer free ends being capable of being squeezed inward toward each other and of springing back to their original positions for insertion into the mounting opening in the casing wall and engagement with the casing, whereby the angled flanges of said side walls become positioned directly against the laterally opposed inner surfaces of said casing wall adjacent said mounting opening, and (c) the outermost edges of said top and bottom walls are curved to accommodate the curved outer surface of said casing wall.

11. The fan housing assembly of claim 10 which includes a cover member curved to seat against the inner surface of the mounted casing wall and dimensioned to cover the mounting opening of said casing wall, said cover member comprising a four-sided curved plate, said plate having (a) an integral upper tab centrally located on its top edge, said tab projecting backward from the concave front face of said plate and terminating in an upwardly directed portion, (b) two integral lower tabs formed by bending backward from said front face of said plate two rectangular sections of said plate along its side edges, the lateral spacing between said two lower tabs being such that, when said plate is mounted against the inner surface of the mounted casing wall, said lower tabs fit snugly within the mounting element and press outwardly its side walls, and (c) a hole adjacent the bottom edge of said plate; and wherein said casing wall is provided with (i) a cutout along the edge defining the top side of the mounting opening, said cutout forming a receiving opening between said casing wall and the top wall of said mounting element for insertion therethrough of said upper tab of said plate, and (ii) a hole located below said mounting opening so that, when said upper tab of said plate is inserted in said receiving opening and said plate is rotated downward to a generally vertical position against the mounted casing wall, said casing hole becomes aligned with said hole in said plate and said plate is secured against said mounted casing wall by a fastener inserted through said aligned holes.

12. The fan housing assembly of claim 11 wherein the mounting element is provided with (a) a recess located along the curved outer edge of the bottom wall for attachment thereto of a ground clip, and (b) a knockout panel located in each of the top and side walls, whereby electrical wiring can be routed through an opening obtained by removal of one of said knockout panels, and the plate is provided with an aperture for mounting therein of an electrical outlet having leads to a source of electrical power.

13. The fan housing assembly of claim 12 wherein (a) the stud of the decorative grill is threaded and the opening in the bight of the U-shaped strip comprises a generally circular split tapered hole, and (b) the damper plates are molded of a plastic material, with the tabs of each plate being half-cylindrical and the cooperating apertures in the casing wall being not fully circular holes, whereby said each plate is supported in the generally horizontal position with the flat diametrical surface of each of its tabs in a generally horizontal position and is rotatable by air blown through the casing to a generally vertical position wherein said flat surface of each tab assumes a generally vertical position.

14. The fan housing assembly of claim 13 wherein each of the cooperating apertures is a generally convexo-concave shaped opening, the axis of curvature of each of said openings projecting upwardly from the horizontal plane toward the diametrical plane of the casing extending between the apertures of each pair thereof.

15. The fan housing assembly of claim 4 wherein the mounting element is provided with (a) a recess located along the curved outer edge of the bottom wall for attachment thereto of a ground clip, and (b) a knockout panel located in each of the top and side walls, whereby electrical wiring can be routed through an opening obtained by removal of one of said knockout panels, and the plate is provided with an aperture for mounting therein of an electrical outlet having leads to a source of electrical power.

16. The fan housing assembly of claim 1 wherein each of the cooperating apertures is a generally convexo-concave shaped opening, the axis of curvature of each of said openings projecting upwardly from the horizontal plane toward the diametrical plane of the casing extending between the apertures of each pair thereof.

* * * * *